United States Patent [19]

Teranishi

[11] 4,046,289

[45] Sept. 6, 1977

[54] LATHERING DEVICE

[75] Inventor: Akihiko Teranishi, Nagoya, Japan

[73] Assignee: Kabushiki Kaisha Teranishi Denki Seisaku-Sho, Japan

[21] Appl. No.: 688,953

[22] Filed: May 24, 1976

[30] Foreign Application Priority Data

| | | |
|---|---|---|
| May 30, 1975 | Japan | 50-64150 |
| Dec. 27, 1975 | Japan | 50-156999 |
| Oct. 24, 1975 | Japan | 50-144248[U] |
| Nov. 7, 1975 | Japan | 50-150738[U] |
| Dec. 29, 1975 | Japan | 51-178759[U] |
| Mar. 11, 1976 | Japan | 51-28077[U] |
| Nov. 7, 1975 | Japan | 50-150739 |

[51] Int. Cl.[2] ..... B67D 5/62

[52] U.S. Cl. ..... 222/146 HE; 222/333; 222/252; 222/190; 252/359 E; 259/10

[58] Field of Search .... 222/146 HE, 146 H, 146 HA, 222/146 HS, 333, 413, 130, 195, 252, 254, 190; 252/359 E; 239/343; 259/10

[56] References Cited

U.S. PATENT DOCUMENTS

| | | | |
|---|---|---|---|
| 2,495,441 | 1/1950 | Campbell | 259/10 |
| 2,925,202 | 2/1960 | Stevens | 222/190 |
| 3,119,779 | 1/1964 | Barrows et al. | 252/359 E |
| 3,355,151 | 11/1967 | Menzel | 259/10 |

*Primary Examiner*—Allen N. Knowles
*Attorney, Agent, or Firm*—Moonray Kojima

[57] ABSTRACT

A lathering device for providing shaving foam from liquid soap, wherein liquid is stored in a lower portion and forced upward by a vertical screw to an upper portion whereat the liquid is agitated into foam and ejected.

16 Claims, 20 Drawing Figures

LATHERING DEVICE

BACKGROUND OF THE INVENTION

This invention relates to lathering devices and more particularly to a motorized lathering device which produces foam from liquid.

In the prior art, lathering devices generally have a storage tank for the liquid provided at the upper portion and the liquid flows downwards. Since the liquid tends to go out in amounts exceeding the necessary amount when it stands as it is, it is necessary to provide a checking valve thereby resulting disadvantageously in complications of structure, clogging or abrasion in the valve mechanism, etc. In such foregoing devices, even when the motor is stopped and the valve is closed a screw is further rotated due to inertia and accordingly foam continues to be emitted continuously. Thus, a further means is necessary to prevent foam and liquid leakage.If the soap liquid is retained in the container for a long period of time, the soap composition is deposited at the bottom and the concentration of liquid tends to vary and be thicker toward the bottom. This brings about differences in foam quality at the beginning and end of the liquid in the container. Further, in the conventional devices, the liquid flows downwards to be ejected instantaneously, and immature foam is often ejected. Moreover, disadvantageously, even if prior devices were provided with the liquid tank at the upper part and the driving mechanism at the lower part, the liquid within the screw case will counterflow into the tank concurrently with the stoppage of rotation of the screw. Thus, even if the motor is driven to agitate the liquid, lathering or foaming will not occur.

The conventional lathering device has the sme connector as in existing electrical products at the electric source; the motor is not independent of the case. Thus, for example, when filling liquid into the tank, the motor may suddenly start.

It has been suggested to introduce air into the container for forming foam. However, if an air inlet hole is merely formed, in general, the quantity of foam which is generated exceeds the necessary amount and the liquid will become rapidly exhausted. The quantity of foam depends upon the soap liquid and it is not easy to obtain foam of uniform quality.

SUMMARY OF THE INVENTION

The invention aims to remove the above and other shortcomings of the prior art.

The foregoing and other objects are attained in this invention which encompasses, in its broader aspects, an automatic lathering device comprising a container having an upper portion and a lower portion for storage of liquid soap, a motor disposed toward the top of the container and having a rotatable shaft, an agitating means attached to the shaft and disposed in the upper portion of the container, a screw means attached to said shaft and located in the lower portion of the container, means extending from the lower portion to the upper portion for containing the screw means with an inlet for liquid, air hole means for both the upper and lower portions and outlet means positioned at the upper portion, whereby the motor rotates the screw means to lift up the liquid into the upper portion and the agitating means lathers the liquid for ejection through the outlet.

A broad feature of the invention are means forcing the liquid from the lower portion to the upper portion for agitation to provide suitable quality and quantity of foam.

Another feature of the invention provides a lever at the screw mechanism to instantly discharge the foam in response to starting of the motor.

A further feature of the invention is use of divided cases and an electric connection to provide electrical stability and ease, within the divided cases.

A further feature is the inlet for admitting air into the liquid tank and the inlet for admitting air into the agitating chamber to make the foam fine and the discharging smooth.

A still further feature elastically connects a motor shaft and a screw shaft to enable the adjustment of the shaft for greater durability.

Another feature of the invention is a lever mechanism provided for the air inlet to prevent excessive discharge of foam due to any inclining angle of the container.

Other objects, features and advantages of the invention will become more apparent from the following description with reference to the drawing.

DETAILED DESCRIPTION OF PREFERED EMBODIMENTS

Figure 1:
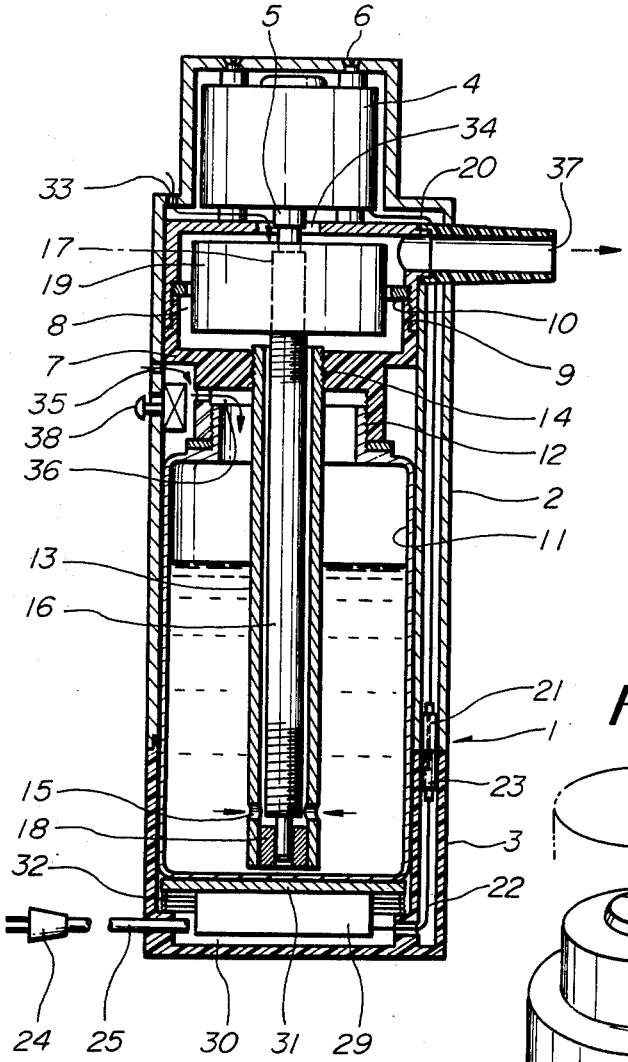
FIG. 1 is a cross sectional front view of an illustrative embodiment of the invention.

In FIG. 1 there is depicted a container 1 comprising an upper case 2, a lower case 3, and a motor 4 held at the upper most part of container 1 with a screw 6. A securing member 7 defines an agitating chamber 8 and is fixed to the upper case 2 at a screwing portion 9, and its upper surface supports the motor 4. There is provided a circular rib 10 protruding into the agitating chamber 8 on an inner wall. A tank 11 containing soap liquid is opened at its upper part and is fixedly secured to the securing member 7 by means of a screwing part 12.

A screw case 13 is almost entirely positioned within the liquid tank 11, and screwed vertically to the securing member 7 with a screw part 14 and formed with a liquid inlet 15 at the lower end of the side wall.

A screw 16 is inserted in the screw case 13. A screw shaft 17 extending from the upper portion of screw 16 is coaxial with and connected to motor shaft 5. Its lower end is received by a bearing metal 18 provided within the lower part thereof. The screw shaft 17 has attached thereto an agitating fan 19 positioned in chamber 8 in such a way that the fan 19 does not touch rib 10.

A lead wire 20 is arranged in the case for energizing the motor 4 with one end connected to motor 4 and the other end connected to a connector 21 at the lower end within upper case 2.

A lead wire 22 is arranged in the case for connection to an electric source, one end being connected to a connector 23 at the upper end within the lower case 3 and the other end connected to cord 25 having a plug 24.

Figure 2:
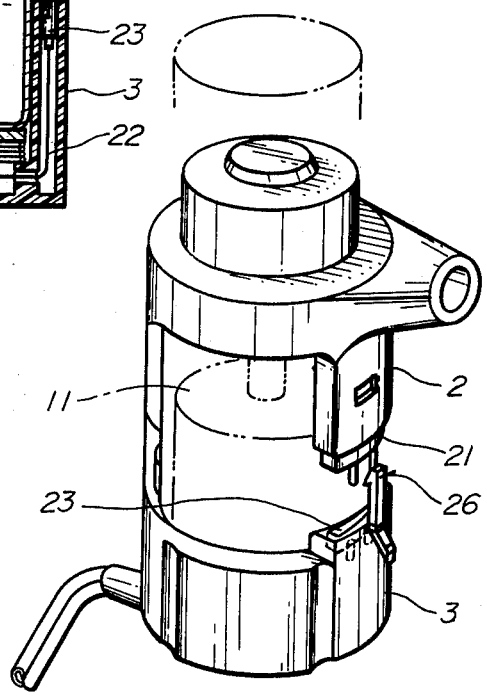
FIG. 2 is a perspective view showing parts of the embodiment of FIG. 1.
Figure 3:
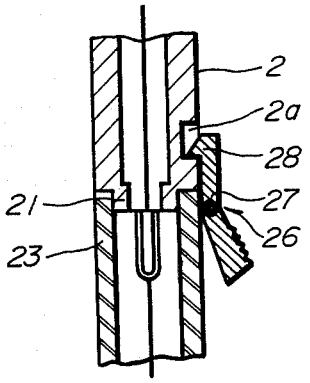
FIG. 3 is a cross sectional view of a part of the embodiment of FIG. 1.

Details of th connectors 21 and 23 are shown in FIGS. 2 and 3. The connector provides electrical conduction and serves to firmly engage the upper case 2 and the lower case 3. A locking member 26 may be effectively used to secure engagement as shown in FIGS. 2 and 3. This member 26 is pivotally connected to the lower case 3 with an axis 27, and a fitting portion 28 formed at its upper end to be engaged with a concave cut out **2*a* of the upper case 2** for locking both cases together.

Returning to FIG. 1 there is arranged a heating element 29 in a space 30 defined between the bottom of lower case 3 and liquid tank 11. Heating element 29 is connected to lead wire 22 for the electric source and to cord 25. Heat generated by heating element 29 is conducted to the base of tank 11 via a heating plate 31 for instantly forming the foam of the liquid soap held in the tank. The heating plate 31 is pressed to the base of tank 11 by action of a spring 32 for preferable heating conduction.

An air inlet 33 is formed at an upper portion of upper case 2, and the air flows through inlet 33, as shown by the arrow, into agitating chamber 8, through motor shaft 5 and hole 34, which serves to contain shaft 17.

An air inlet 35 is formed under securing member 7 in the side wall of the upper case 2, and air flows through inlet 35, as shown by the arrow, into tank 11 through passage 36 in securing member 7.

A foam outlet 37 above rib 10 communicates with agitating chamber 8 of securing member 7. The motor 7 is operated by switch 38.

The operation of this device is as follows. When plug 24 is connected to an electric outlet, not shown, and switch 38 is turned on, motor 4 is driven to rotate screw 16 and the liquid soap which is led into the screw case 13 through inlet 15 and lifted by screw 16 to be fed into agitating chamber 8 via a space between the screw case 13 and screw 16. The liquid fed into the chamber 8 is agitated by agitator fan 19 fixed to screw shaft 17. In this instance, since the circular rib 10 is provided under outlet 37 in the inner wall of chamber 8, the liquid therein is not instantaneously ejected, but is ejected after having been fully agitated.

Figure 4:
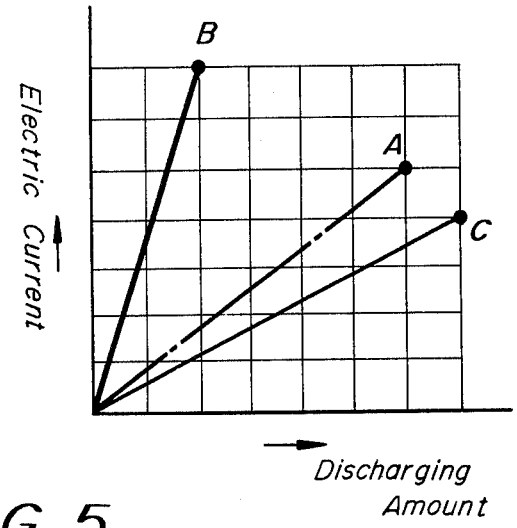
FIG. 4 is a graph depicting the relation between the air inlet, electric current and foam discharge amount.

When the air inlet 33 is closed, load on the motor increases as shown by line A in FIG. 4 and the amount of the discharged foam decreases. When the air inlet 35 is closed, load on the motor remarkably increases as shown by line B and the amount of discharged foam considerably decreases. According to the invention, both outlets 33 and 35 are opened to decrease the load as shown by line C and increase the amount of discharged foam. Thus, the desired effect is obtained by using air inlets of simple design.

Figure 5:
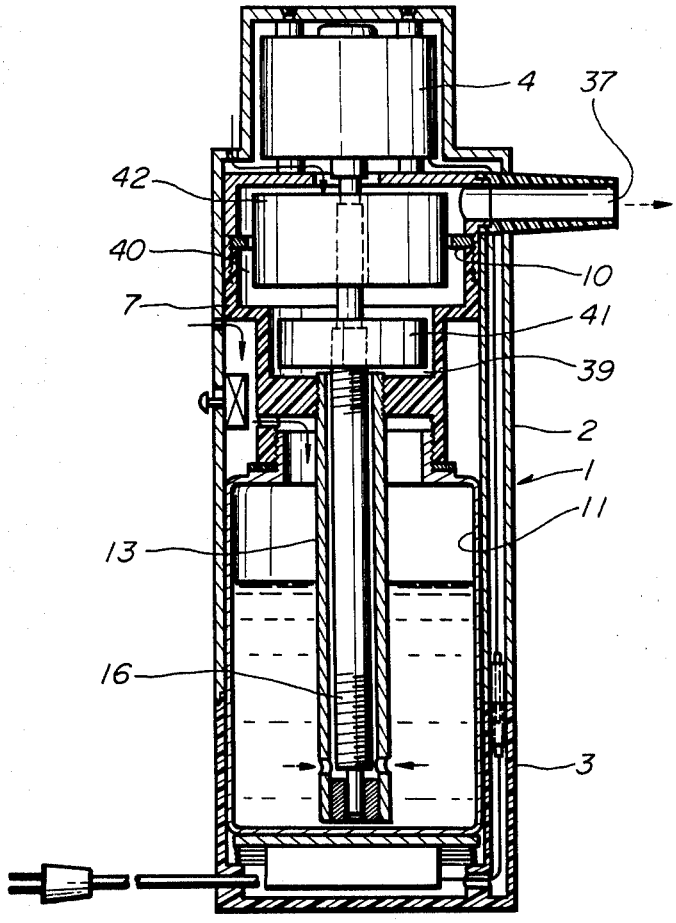
FIG. 5 is a cross sectional front view of another illustrative embodiment of the invention.

FIG. 5 shows another embodiment wherein two agitating chambers and two agitating fans are used. A securing member 7 installed in the upper case is provided with a first agitating chamber 39 and a second agitating chamber 40 at its upper and lower parts. A first agitating fan 41 and a second agitating fan 42 are fixed to a screw shaft 17 coaxial with the motor shaft positioned in the chambers. In this embodiment, the circular rib 10 is provided in an inner circumferential wall of the upper second agitating chamber 40. Other members than those above mentioned are the same as in the embodiment of FIG. 1 and are not further discussed hereat.

Operation of this other embodiment of FIG. 5 is as follows: The motor 4 is driven by operaton of a switch 38 to rotate screw 16 and feed the liquid into the first agitating chamber 39. In this instance, since the second agitating chamber 40 is not yet filled with foam and the air flows from the second chamber 40 to the first chamber 39, first fan 41 agitates the soap liquid into gel or foam while generating counter pressure (negative pressure), and then feeds the liquid into the second agitating chamber 40. In this connection since the second fan 42 positioned in the second agitating chamber 40 has a pressure mechanism, the liquid which has been completely made fine is discharged from the outlet. The second agitating chamber 40 is still filled with foam and the air is prevented from flowing from the second chamber 40 to the first chamber 39 and the counter pressure of the first agitating fan 41 is weakened and hence discharging of the foam is not weakened. Thus, the foam is prevented from being ejected in an incompletely foamed condition.

Figure 6:
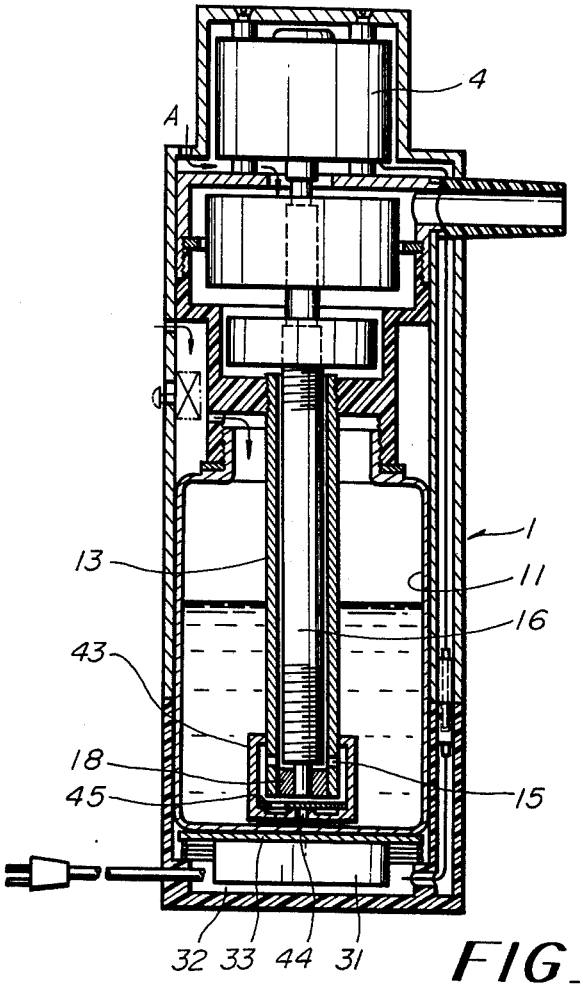
FIG. 6 is a cross sectional front view of a further illustrative embodiment of the invention.
Figure 7:
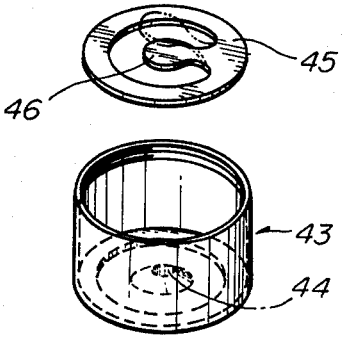
FIG. 7 is a perspective view of a disassembled part of the embodiment of FIG. 6.

FIGS. 6 and 7 depict a further illustrative embodiment of the invention, in which a housing 43 is provided at the lower portion of screw case 13 and is formed with a liquid inlet 44 at its bottom and is furnished with a check valve 45 which is made of elastic material. This check valve 45 is closed in an inlet hole, when the screw 16 is not rotating, as shown in FIG. 6 (shown with solid line in FIG. 7). When the screw 16 rotates, a valve portion 46 arises as shown with dotted lines in FIG. 7 for introducing liquid from tank 11 into the screw case 13.

Figure 9:
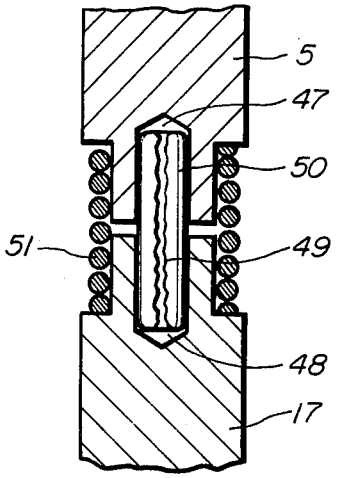
FIG. 9 is a cross sectional view of a part of the embodiment of FIG. 8.
Figure 8:
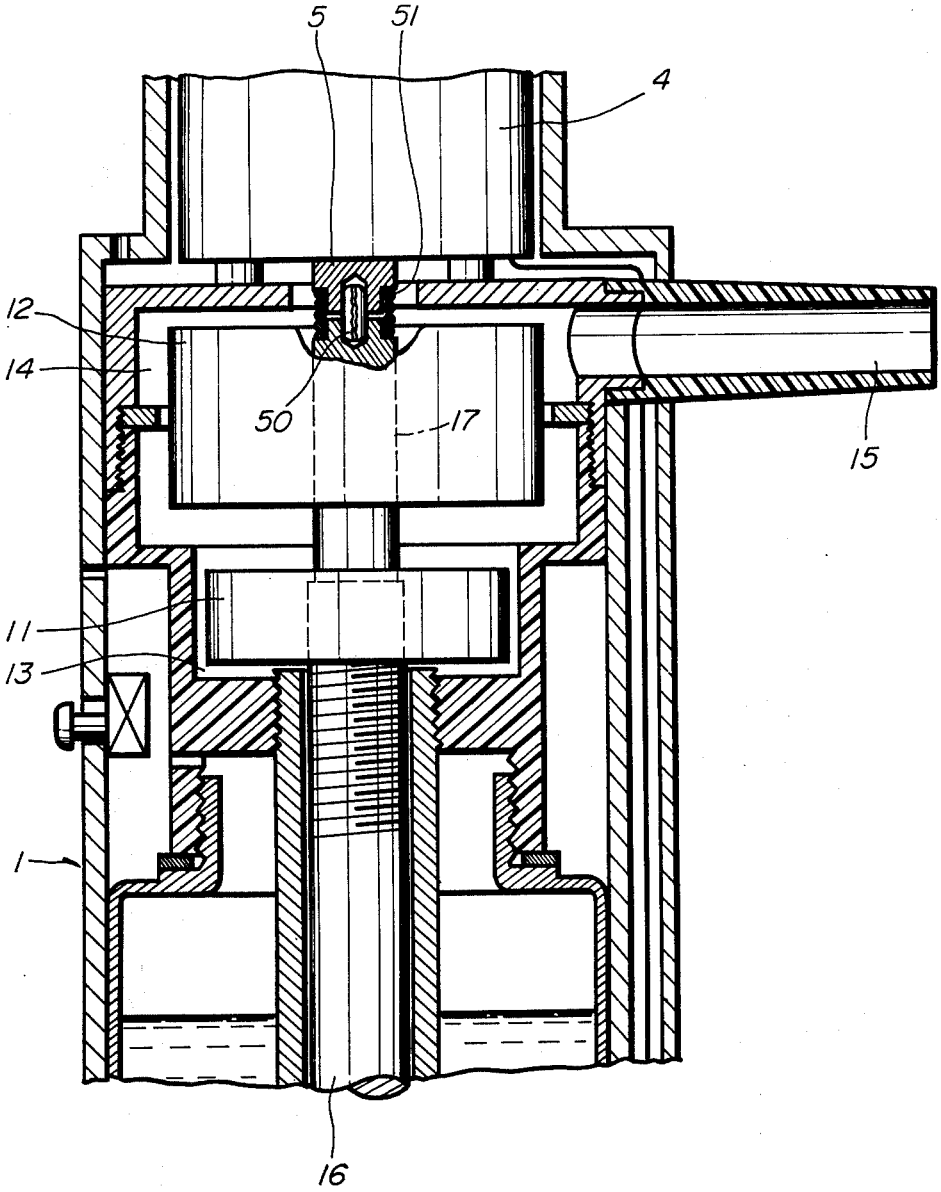
FIG. 8 is a cross sectional view of another illustrative embodiment of the invention.
Figure 10:
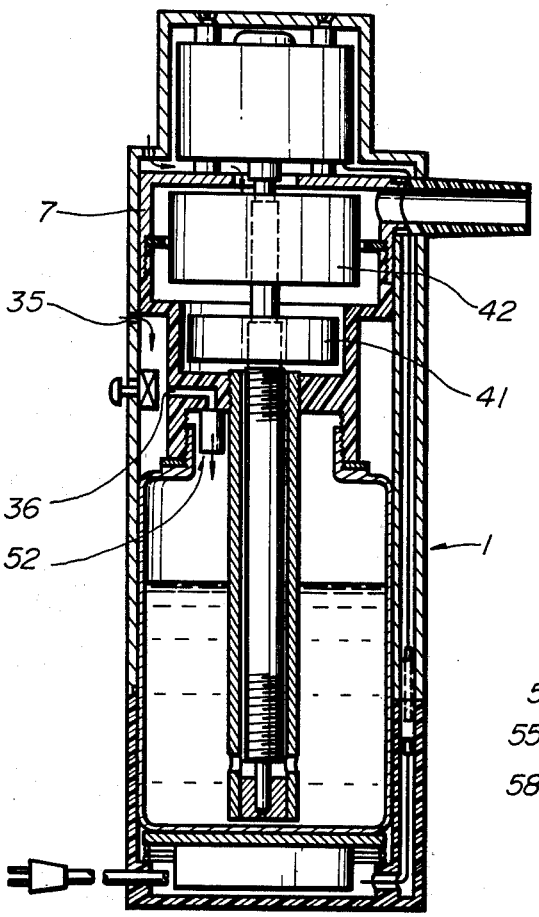
FIG. 10 is a cross sectional side view of a further embodiment of the invention.
Figure 13:
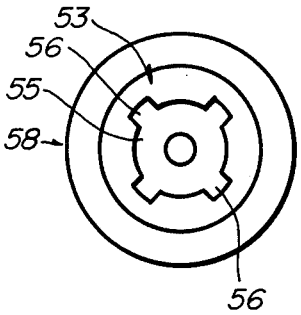
FIG. 13 depicts an upper part of the FIG. 10 embodiment.

FIGS. 8 and 9 depict a still further illustrative embodiment of the invention, wherein the motor shaft 5 and the screw shaft 17 are formed with holes 47,48 (see FIG. 9) in an axial direction where a hollow spring pin 50 with groove 49 in its length is inserted to coaxially connect both shafts for transmitting driving force. The shafts have at the connecting ends grooves for placement of springs 51 which work to prevent racing meeting deflection due to the shaft length and use of the sole spring pin.

FIGS. 10 through 14 depict an air inlet device 52 in which a fitting portion 53 (see FIGS. 12,13) is formed by partially projecting the securing member of the inner circumferential end of air inlet 36 of securing member 7 communicating with air inlet 35 formed in upper case 2. The fitting portion 53 is formed with a valve space 55 for holding a small valve body 54 (see FIG. 11) and is vertically formed with grooves 56 of appropriate number in its inner wall, so that the air which is led from air passage 57, having its end part chamfered continuously from air hole 36, as shown with arrows in FIG. 12, into tank 11 through a later mentioned air valve 58 and vertical grooves 56.

Figure 12:
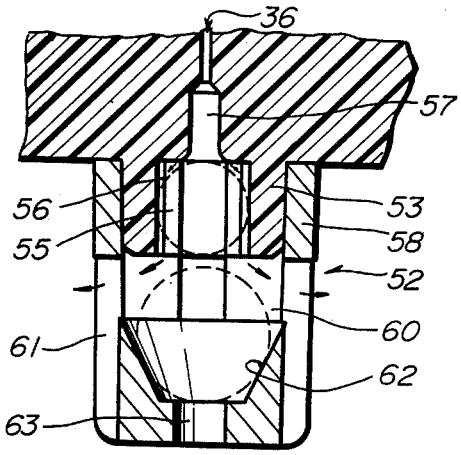
FIG. 12 is a further enlarged cross sectional view of part of the embodiment of FIG. 10.
Figure 14:
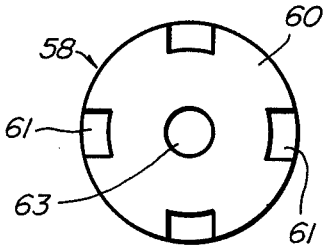
FIG. 14 depicts a lower part of the FIG. 10 embodiment.
Figure 11:
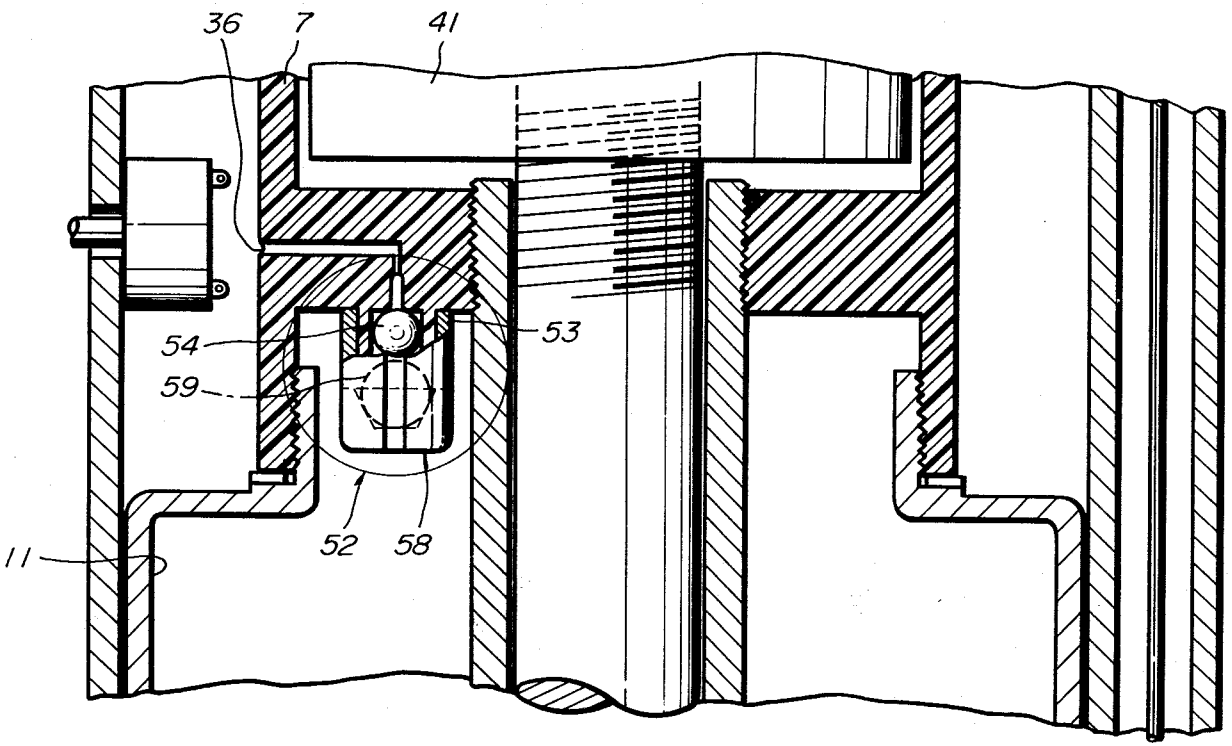
FIG. 11 is an enlarged cross sectional view of a part of the embodiment of FIG. 10.
Figure 15:
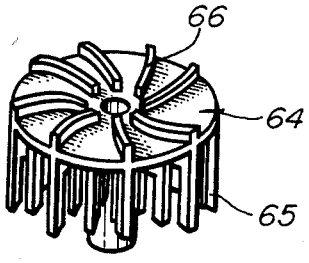
FIG. 15 is a perspective view of an agitating fan.
Figure 16:
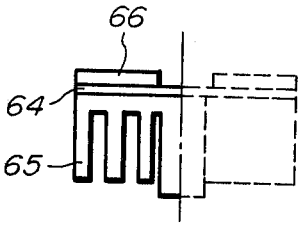
FIG. 16 is a side view of the embodiment of FIG. 15.
Figure 17:
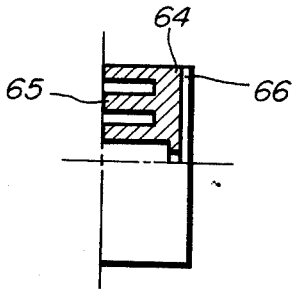
FIG. 17 is a partial cross sectional view of the embodiment of FIG. 15.

The air valve case 58 is fitted as shown in FIG. 12 to the fitting portion 53 of the securing member, in which valve space 60 for holding a large valve body 59 (see FIG. 11) is formed, and is vertically provided with grooves 61 of appropriate number serving also as an air passage and is formed with a taper at its bottom for stabilizing the large valve 59 and is formed with a passage 63 at the end of the case.

Use of one valve is sufficient; however, use of both the large and small valves is more preferable. When this lathering device is inclined steeply during use, the small valve rotates to close the air passage and prevent the air from flowing into the tank as well as prevent the liquid in the tank from flowing into the air passage. At this time, the large valve serves as a sinker to help the small valve. Since the small valve itself is light in weight it cannot perfectly close the air passage and therefore the large valve, which is of suitable weight, presses the small valve to the air passage. Thus, the air is substantially prevented from flowing into the tank, and pressure in the tank is reduced thereby to move slightly the small and large valves together with action of the screw mechanism since the large valve is of such suitable weight and will be moved by this reduced pressure. The air flows into the tank through the small space so that the air and the liquid are preferably mixed thereby to discharge a suitable amount of foam and avoid excessive amounts.

Figure 18:
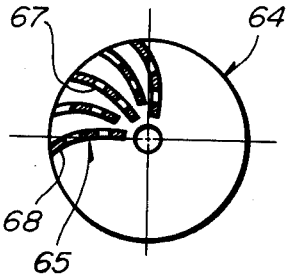
FIG. 18 depicts a lower part of the embodiment of FIG. 15.
Figure 19:
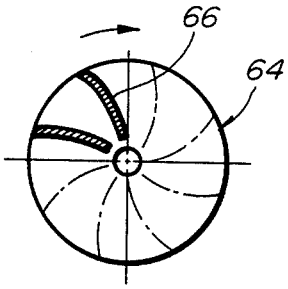
FIG. 19 depicts an upper part of the embodiment of FIG. 15.
Figure 20:
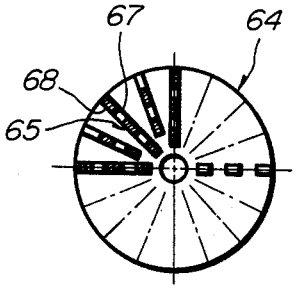
FIG. 20 depicts a lower part of another agitating fan.

FIGS. 15 through 20 depict aspects of the agitating fan. The fan provides agitation and pressure in the device to enable foaming of the liquid soap. Depicted is a fan body 64 having at its lower at its lower part with a pluraity of lower fan parts 65 for agitating and discharging the liquid, having cut-out radial or arc shaped projections. At its upper part there are provided a plurality of fan parts 66 for pressing and discharging the liquid. The upper fan parts 66 have arcs as depicted. The lower fan 65 is rectangular and is formed alternately with concave portions 67 and convex portions 68 as shown in FIGS. 18 and 20. The upper fan 66 is shorter in height than the lower fan 65 and may have fewer blades. The foam agitated by the lower fan 65 is mixed with the air by the upper fan 66 to be suitable and is discharged thereby, and therefore the height of the blade may be lower for effectively forming foam. In other words, if the upper fan part 66 has a longer vertical blade, emitted amounts will be excessive and there will be a tendency to discharge immaturely formed foam.

According to the invention, the driving mechanism of the motor 4 is driven to lift up the liquid from the tank using the screw and the liquid is agitated in the upper chamber and discharged, so that if the motor is stopped, the screw mechanism is also stopped and since lifting action is concurrently stopped, the liquid is preferably drained downward.

As forcible lifting is effected by the screw, the liquid at the bottom of the tank is moderately agitated and the difference in the soap content is small and the discharged foam is always uniform.

In the present device, there are provided successively in descending order, the motor, agitating fan, screw and tank; and this device may be applied to the standing type or the suspended type of device. Further, the motor is positioned at the upper part and the agitating fan in the tank does not contact the electrical mechanism.

The agitating chamber is sectioned with the circular rib, and the liquid supplied to the one chamber is not directly discharged. Both upper and lower agitating mechanisms fully agitate the liquid into foam.

The case is divided into the upper and lower parts, and the liquid tank is easily attached and detached.

The electric connection between the driving source and the driving mechanism is housed within the casing, thus giving a neat appearance.

The air passage to the liquid tank accelerates the liquid flowing into the agitating chamber. This liquid is mixed with the air from another air passage to be agitated into fine foam. If the air passage to the agitating chamber is closed, load on the motor is increased and the discharging amount is decreased. If the air passage to the liquid tank is closed, the electric current becomes high and the discharging amount is decreased. Thus, the air passage is preferably open during operation.

A check valve is employed in the screw mechanism so that even if the liquid is lowered in the tank, the liquid surface in the screw casing is kept constant, and thus, the turning on the device, the foam will be instantly discharged. The inlet of the screw mechanism is positioned at the bottom of the tank so that the entire liquid content may be used.

The motor shaft and screw shaft are coaxial and elastically connected together to adjust the shafts and contribute to their durability.

The air passage to the liquid tank may be provided with an air control device wherein a valve is automatically worked by inclining the lathering device, to prevent air from flowing into the liquid tank and so that pressure in the tank is reduced to prevent the liquid from flowing via the screw mechanism into the agitating tank and discharging. The air is prevented from flowing into the tank as well as the liquid being prevented from escaping out of the air passage.

The agitating fan is provided with upper and lower fan parts having the discharging and pressing functions. Two fans may be provided separately to serve the same functions. The lathering device may be miniaturized with consequent reduction in materials.

The heating part is arranged at the bottom of the lower case of the tank and accelerates the creation of the foam and thus reduce loss of driving force and enable discharge of foam in a short period of time.

The foregoing description is illustrative of the principles of the invention. Numerous other variations and modifications thereof would be apparent to the worker skilled in the art. All such variations and modifications are to be considered to be within the spirit and scope of the invention.

What is claimed is:

1. A lathering device comprising an outer casing;

a first chamber disposed within said outer casing, for storage of liquid soap;

one or more second chambers disposed within said outer casing and above said first chamber;

heater means for heating said liquid soap;

an elongated hollow means having two ends, one end being closed with an opening near the end and the other end being open, said hollow means disposed to connect said first chamber and said second chamber with said one end disposed with the closed end toward the bottom of said first chamber thereby providing a path for passage of said liquid soap through said opening at the closed end, through said hollow means and into said second chamber;

outlet means located at said second chamber;

motor means having a shaft, disposed above said second chamber;

agitating means disposed within said second chamber;

screw means disposed within said hollow means and extending through a substantial portion thereof;

joining means connecting said motor shaft, to said agitating means and to said screw means; and air passage means for enabling air to controlledly travel into said first and second chambers from outside of said outer casing, whereby operation of said motor turns concurrently both said agitating means and said screw means to cause said screw means to lift up said liquid soap through said hollow means from said first chamber into said second chamber to cause said agitating means to effect foaming of said liquid soap and ejection of said foamed liquid soap through said outlet means.

2. The device of claim 1, wherein said outer casing comprises an upper part, a lower part, and means for locking firmly together said upper part and said lower part.

3. The device of claim 1, wherein said outer casing comprises electric connector means for electrically connecting said motor to an electric source, said electric connector means comprising a wire disposed in said upper part and connected to said motor, a wire disposed in said lower part and connectable to said electric source; and interconnected terminal means electrically connecting the wires of said upper part to said wire of said lower part.

4. The device of claim 1, wherein two second chambers are provided with each second chamber having disposed therein an agitating means, and one second chamber disposed above the other second chamber.

5. The device of claim 1, wherein said second chamber comprises a circular rib disposed in an inner circumferential wall of said second chamber and below said outlet means and at suitable distance from said agitating means.

6. The device of claim 1, wherein said agitating means comprises a fan having base, an upper part connected to the upper surface of said base and a lower part connected to the lower surface of said base.

7. The device of claim 6, wherein said lower part comprises a plurality of radially shaped blades with concave and convex shapes.

8. The device of claim 6, wherein the upper part has a plurality of arc shaped blades.

9. The device of claim 7, wherein the concave and convex shapes are disposed alternately.

10. The device of claim 6, wherein the upper part is shorter in vertical length from said upper surface of said base than the vertical length of said lower part from said lower surface of said base.

11. The device of claim 6, wherein said elongated hollow means comprises bearing means disposed at the closed end of said hollow means.

12. The device of claim 1, wherein said hollow means comprises a housing to seal the lower end thereof, and a check valve at the opening located at the closed end of the hollow means and operable to an open position when the screw means rotates and operble to a closed position when the screw means stop rotation.

13. The device of claim 1, wherein said motor shaft has a coaxial hole in the end thereof, and said screw means has a shaft having a coaxial hole therein, and wherein said joining means comprises a tubular pin means of elastic material provided within the holes of said shaft and said screw means, said shaft and said screw means are coaxially disposed with the ends thereof in close proximity, and spring means disposed commonly to both said shaft and said screw means.

14. The device of claim 1, wherein said air passage means comprises a first air passage between the outside of said outer casing and said first chamber, and second air passage between the outside of said outer casing and said second chamber, and valve means for automatically closing said first air passage when said device is at an incline.

15. The device of claim 14, wherein said valve means comprises a valve casing, a small valve, a large valve, a first valve space formed within said valve casing and having at its inner side a plurality of vertical grooves, said small valve fitting into said said first valve space, a second valve space formed in said valve casing disposed in said first chamber, and having at its outside a plurality of vertical grooves, said large valve fitting in said second valve space.

16. The device of claim 1, wherein said heating means comprises a heating plate disposed below said first chamber.

* * * * *